United States Patent [19]

Milne et al.

[11] Patent Number: 4,638,713

[45] Date of Patent: Jan. 27, 1987

[54] THERMAL SLEEVE FOR GUN BARRELS

[75] Inventors: Alistair R. Milne, Washington; Grenville Davison, Newcastle Upon Tyne, both of England

[73] Assignee: Vickers Public Limited Company, London, England

[21] Appl. No.: 801,573

[22] Filed: Nov. 25, 1985

[30] Foreign Application Priority Data

Nov. 26, 1984 [GB] United Kingdom ..... 8429775

[51] Int. Cl.[4] ..... F41F 17/04; F41F 17/06

[52] U.S. Cl. ..... 89/14.1; 89/16

[58] Field of Search ..... 89/14.05, 14.1, 16, 89/36.01, 36.06; 42/76 A; 493/966; 428/73

[56] References Cited

U.S. PATENT DOCUMENTS

| | | | |
|---|---|---|---|
| 1,379,339 | 5/1921 | Haskell | 89/14.1 |
| 4,061,812 | 12/1977 | Gilwee, Jr. et al. | 428/73 |
| 4,346,643 | 8/1982 | Taylor et al. | 89/14.1 |
| 4,424,734 | 1/1984 | Janssen et al. | 89/16 |

FOREIGN PATENT DOCUMENTS

| | | | |
|---|---|---|---|
| 0033770 | 8/1981 | European Pat. Off. | 89/16 |
| 1918422 | 10/1970 | Fed. Rep. of Germany . | |
| 3005117 | 8/1981 | Fed. Rep. of Germany . | |
| 0133091 | 10/1919 | United Kingdom | 89/14.05 |

*Primary Examiner*—Stephen C. Bentley
*Assistant Examiner*—Stephen Johnson
*Attorney, Agent, or Firm*—Merchant, Gould, Smith, Edell, Welter & Schmidt

[57] ABSTRACT

A thermal sleeve for a gun barrel is in the form of a cylinder of a substantially rigid thermally insulating material with a series of longitudinally and circumferentially spaced spacer members disposed on the inner face of the cylinder. The spacer members engage with the gun barrel and define an annular gap between the cylinder and the barrel. The sleeve further includes means for sealing the annular gap as well as means for securing the cylinder on the barrel to ensure pressurized contact of the spacer members with the barrel.

5 Claims, 7 Drawing Figures

THERMAL SLEEVE FOR GUN BARRELS

BACKGROUND OF THE INVENTION

This invention relates to thermal sleeves for location on gun barrels and has particular though not exclusive application to such sleeves for the gun barrels of tanks.

Tank gun barrels, particularly those over about 3 inches calibre, tend to be long and consequently there is a tendency for the barrels to distort when they are subjected to differential heating conditions such as occur with, for example, the heat of the sun on one side of the barrel and a cold wind on the other side.

Accurate long range shooting depends upon the barrel being perfectly straight, and, in order to insulate the barrel from the effects of the environment, it has become standard practice to provide one or more thermal sleeves for the barrel. Such sleeves commonly comprise blankets of asbestos and/or glass fibre wrapped around the barrels, and it has been found that the effects of wind, rain and sun on hot gun barrels encased in such sleeves are considerably reduced.

However, thermal sleeves of this type suffer from a number of disadvantages not the least of which is that they are easily damaged and torn by trees and the like during cross-country manoeuvres, while the sleeves are such as to absorb rain water thereby affecting the balance of the gun. Further, such sleeves do not provide an even heat distribution around the barrel, while heat loss from the barrel is significant resulting in poor thermal signature. In addition, the sleeves tend to become adhered to the barrel after prolonged use, with the result that they cannot be reused on replacement of the barrel, while the problems associated with the use of asbestos are well known.

It has been proposed to attempt to overcome some of these disadvantages by providing sleeves of lightweight metal spaced from the barrel to form an air gap between the sleeve and the barrel. However, the weight of such sleeves must be carefully chosen to ensure that they are sufficiently strong to resist mechanical damage but at the same time being light enough not to effect gun balance and inertia. A metal providing such qualities is magnesium. However it will be appreciated that the inflammability of magnesium can pose grave problems on the battlefield.

SUMMARY OF THE INVENTION

According to the present invention there is provided a thermal sleeve for a gun barrel, the sleeve comprising a cylinder of a substantially rigid thermally insulating material adapted for location over part at least of the gun barrel, a plurality of longitudinally and circumferentially spaced spacer members being provided on the inside face of the cylinder for engagement with the gun barrel to define an annular gap between the cylinder and the barrel, the sleeve further comprising means for sealing said annular gap and means for securing the cylinder on the barrel such that said spacer members make pressurized contact with said barrel.

Although the cylinder of each sleeve may be an integral unit, a preferred sleeve incorporates a longitudinally-split cylinder the two portions of which are hingedly mounted one to the other. In such an embodiment sealing means are provided along the longitudinal joints of said two portions as well as at the ends of the sleeve.

Conveniently the means for securing the cylinder to the barrel comprise a series of axially-spaced circumferential clamps each surrounding the cylinder, each clamp being axially aligned with an associated series of circumferentially spaced spacer members whereby, on tightening of the clamp, said spacer members are urged into pressurised contact with the barrel.

Preferably the material of the cylinder comprises inner and outer layers of, for example, crossplied glass fibre, impregnated with epoxy resin, sandwiching between them a honeycomb core of, for example, a phenolic resin polyimide.

DESCRIPTION OF THE PREFERRED EMBODIMENT

Referring to FIGS. 1 to 4, the material from which the cylindrical portion of sleeves according to the invention is made consists of inner and outer layers or skins 2,4 respectively of crossplied glass fibre impregnated with epoxy resin between which is sandwiched a honeycomb core 6 of a phenolic resin polyomide, the core 6 being secured between the skins 2,4 by an adhesive.

Figure 1:
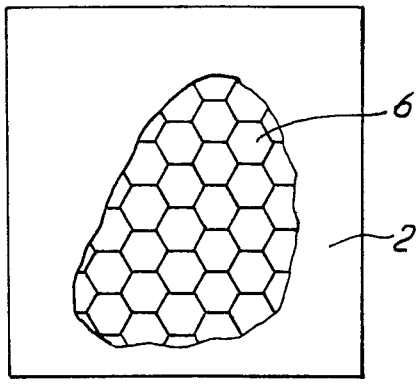
FIGS. 1 to 4 show the material of part of the cylinder of a sleeve according to the invention at various stages during formation into said cylinder.
Figure 2:
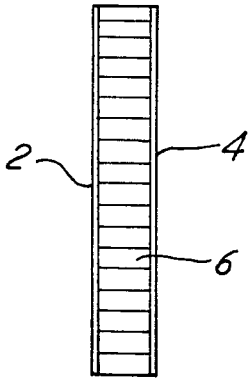

FIG. 1 shows part of the skin 2 cut-away to reveal the core 6, while FIG. 2 is a section through the material showing the individual cells of the honeycomb core each of which extends between the skins 2,4.

Figure 3:
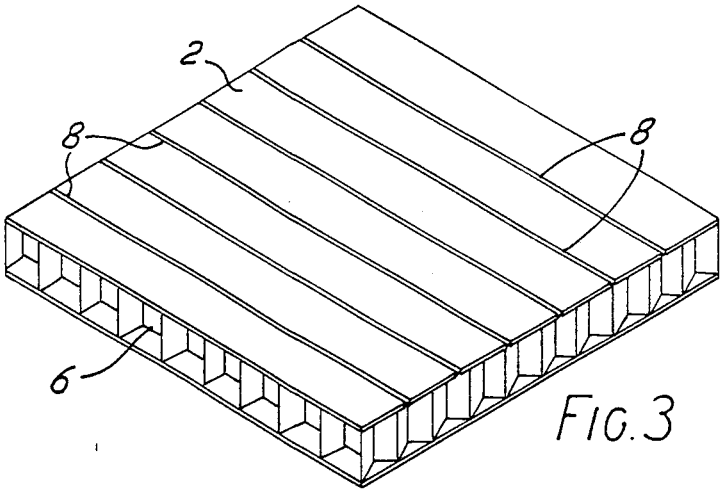
Figure 4:
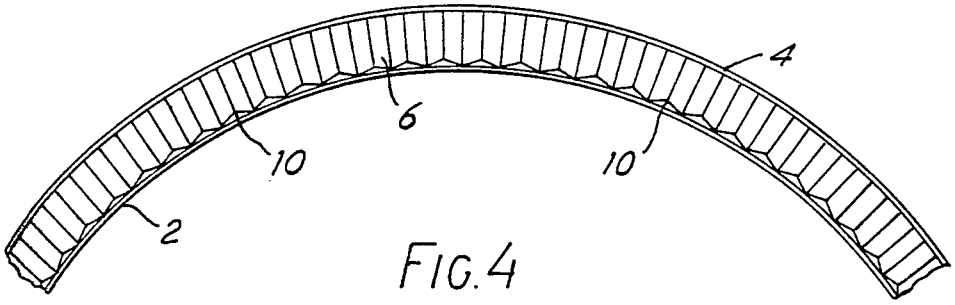

The material initially comprises a flat-sided laminate and, in order to form said laminate into the arcuate shape of FIG. 4, a series of equally-spaced parallel slots 8 are formed in the inner skin 2 as shown in FIG. 3. The laminate can then be bent into a smooth circular arc, the honeycomb of the core 6 adjacent the skin 2 becoming slightly crippled as at 10 on said bending.

Figure 5:
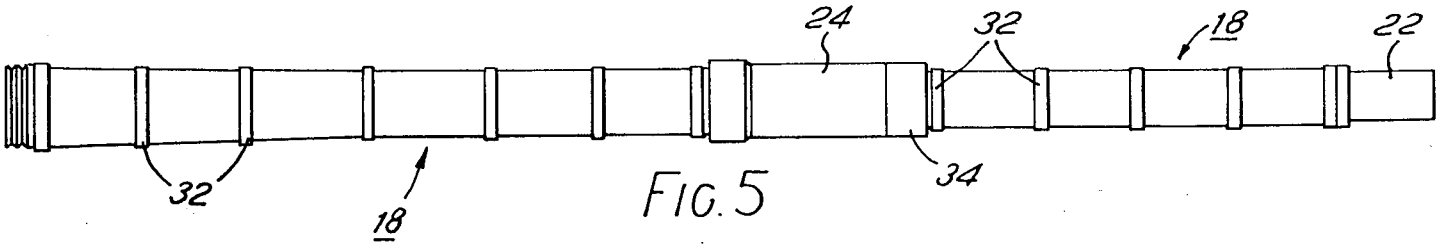
FIG. 5 shows sleeves according to the invention in position on a gun barrel.
Figure 7:
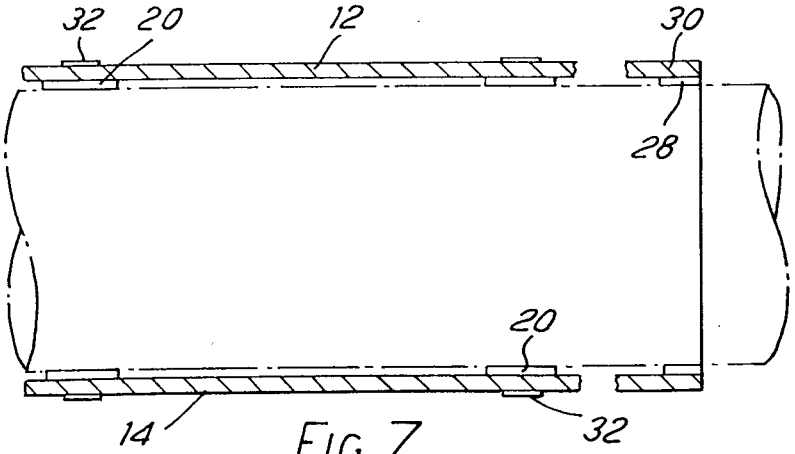
FIG. 7 is a longitudinal section through part of a sleeve of FIG. 5.
Figure 6:
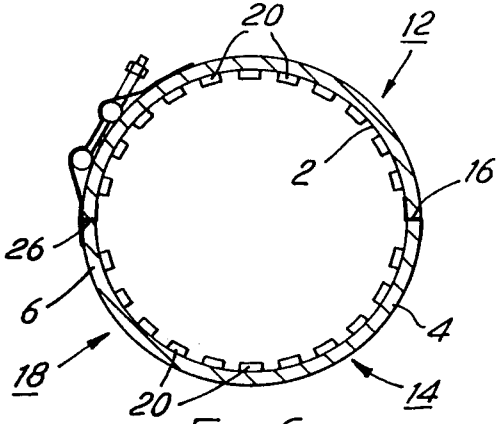
FIG. 6 is a transverse section through a sleeve of FIG. 5.

More particularly and referring to FIGS. 5 to 7, the laminate for each sleeve is bent into two semi-cylindrical portions such as indicated at 12 and 14 in FIG. 6, and these two portions are hinged together along longitudinally abutting edges by a hinge 16 to form a cylindrical sleeve indicated generally at 18. A plurality of circumferentially and longitudinally spaced friction pads are bonded to the inner skin 2 such that, on location of the sleeve 18 on a gun barrel, said pads 20 abut the barrel to define a constant air gap around the barrel.

FIG. 5 shows the gun barrel of a tank, typically of 4.75 inch calibre, having a muzzle 22 and incorporating a fume extractor 24. Two sleeves such as 18 are located on the barrel, one in front of and one to the rear of the extractor 24. Each sleeve 18 is mounted on the barrel to define a sealed, substantially annular volume between the barrel and the inner skin 2, said sealed volume being achieved by providing high-temperature silicone rubber seals 26 along the longitudinally abutting edges of the two semi-cylindrical portions 12,14 as well as annular seals 28 at the ends 30 of each sleeve, and by making the hinge 16 of the same sealing material.

Each sleeve 18 is secured to the barrel by a series of axially spaced, circumferential clamps 32 which may be, for example, stainless steel band clamps or worm drive hose clamps. Conveniently the number of circumferentially spaced pads 20 may be increased locally in the region of the clamps 32 and it will be appreciated that, on tightening of the clamps, the pads 20 are urged into pressurised, frictional contact with the barrel substantially to prevent any movement of the sleeve 18 relative to the barrel.

As well as providing surfaces with a high co-efficient of friction for gripping the barrel, the pads 20, as mentioned above, provide a constant air-gap around the barrel, which gap is itself of a thermally insulating nature and maintains uniform heat distribution on firing of the gun. Further, the provision of such a gap protects the sleeve 18 from making direct contact with the hot barrel, thus preserving the condition of the sleeve and ensuring that the sleeve does not become adhered to the barrel, as occurs with the current arrangements, and can therefore be removed from the barrel for transfer to another barrel. Additionally, the gap between the sleeve and the barrel absorbs some of the energy applied to the gun on impact with, for example, trees or like obstacles.

On existing guns originally designed to receive the conventional blanket-type coverings, it may be necessary to provide an additional counter-balance weight 34 to supplement the light-weight nature of the described rigid sleeve, while on tanks where an external crutch or clamp is used to retain the barrel in its inoperative stored position, the thermal sleeve may be reinforced locally to enable the crutch to clamp directly onto the sleeve—in conventional systems using blankets wrapped round the barrel, the blanket has to be discontinued to enable the crutch to grip the barrel effectively.

Although described as a hinged, two piece construction, sleeves according to the invention may be of an integral, one piece nature, while one or more sleeves may be associated with a gun barrel.

Clearly, the precise nature of the material of the sleeve may be other than as described, providing it is substantially rigid and has thermally-insulating properties.

It will be appreciated that rigid thermal sleeves according to the invention not only overcome many of the inherent disadvantages of the conventional blanket-type coverings but also provide additional advantages in that the high thermal efficiency ensures a reduced thermal signature whilst at the same time providing uniform heat distribution around the barrel. Further, the preferred material of the sleeve is of relatively light weight making the sleeves easy to handle without substantially altering the balance of the gun.

The described sleeves are resilient to potential damage from impact by, for example, trees and the like during cross-country manoeuvres in that the provision of the gap between the sleeve and the barrel absorbs such impacts, while the sleeves are unaffected by rainfall and other natural elements, will outlive the barrel and can therefore be transferred to a new barrel.

What we claim and desire to secure by Letters Patent is:

1. A thermal sleeve for a gun barrel comprising a cylinder of substantially rigid, thermally insulating material shaped to embrace at least part of the gun barrel, a plurality of longitudinally and circumferentially spaced spacer members on the inside face of the cylinder for engagement with the gun barrel to define an annular gap between the cylinder and the gun barrel, means for sealing said annular gap, and a series of axially spaced circumferential clamps each surrounding the cylinder, each clamp being axially aligned with an associated series of circumferentially spaced spacer members whereby, on tightening of the clamp, said spacer members are urged into pressurized contact with the gun barrel.

2. A thermal sleeve as claimed in claim 1 in which the cylinder is longitudinally split into two portions which are hingedly mounted to one another.

3. A thermal sleeve as claimed in claim 2 in which sealing means are provided along both longitudinal joints of said two portions as well as at both ends of the thermal sleeve.

4. A thermal sleeve as claimed in claim 1 in which the cylinder comprises inner and outer layers of a thermally insulating material, and a honeycomb core of a thermally insulating material sandwiched between said inner and outer layers.

5. A thermal sleeve as claimed in claim 4 in which the inner and outer layers are of crossplied glass fibre impregnated with epoxy resin and the honeycomb core is of a phenolic resin polyimide.

* * * * *